US011843192B2

(12) United States Patent
Neef et al.

(10) Patent No.: US 11,843,192 B2
(45) **Date of Patent: *Dec. 12, 2023**

(54) HIGH VOLTAGE CONTACT SYSTEM

(71) Applicant: KYOCERA AVX COMPONENTS Corporation, Fountain Inn, SC (US)

(72) Inventors: Wolfgang Neef, Betzdorf (DE); Marvin Stockschlaeder, Betzdorf (DE); Matthias Techt, Betzdorf (DE)

(73) Assignee: KYOCERA AVX COMPONENTS CORPORATION, Fountain Inn, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/946,228

(22) Filed: Sep. 16, 2022

(65) Prior Publication Data

US 2023/0017724 A1 Jan. 19, 2023

Related U.S. Application Data

(63) Continuation of application No. 16/816,619, filed on Mar. 12, 2020, now Pat. No. 11,450,978.
(Continued)

(51) Int. Cl.
*H01R 12/70* (2011.01)
*H01R 12/51* (2011.01)
(Continued)

(52) U.S. Cl.
CPC ..... *H01R 12/7064* (2013.01); *H01R 4/4818* (2013.01); *H01R 12/51* (2013.01);
(Continued)

(58) Field of Classification Search
CPC .. H01R 4/4818; H01R 12/7064; H01R 12/51; H01R 12/585; H01R 13/665;
(Continued)

(56) References Cited

U.S. PATENT DOCUMENTS 7,175,469 B1 2/2007 Daily et al.
7,374,436 B2 5/2008 Schell et al.
(Continued)

FOREIGN PATENT DOCUMENTS

KR 100849628 B1 8/2008

OTHER PUBLICATIONS

International Search Report and Written Opinion in PCT/IB2020/052255 dated Jun. 29, 2020 (11 pages).

*Primary Examiner* — Briggitte R. Hammond
(74) *Attorney, Agent, or Firm* — Foley & Lardner LLP

(57) ABSTRACT

This disclosure provides a method and apparatus for connecting wires and interlocking wires to an electrical component. More specifically, an electrical connector that includes an insulative housing, two electrical contacts, and two interlocking contacts is disclosed. In an embodiment, each electrical contact includes a female end, a press-fit end, and a transition portion. The transition portion is designed such that the first female end and the first press-fit end may be properly aligned depending on the application. The transition portion also provides support and stability to the electrical contacts when they are disposed within the insulative housing. The insulative housing includes four contact recesses. In an embodiment, the electrical connector allows for the safe, efficient, re-usable, and reliable connection for connecting high-voltage wires to a corresponding sensitive electrical component (e.g., a printed circuit board).

17 Claims, 9 Drawing Sheets

Related U.S. Application Data

(60) Provisional application No. 62/819,022, filed on Mar. 15, 2019.

(51) Int. Cl.

| | |
|---|---|
| ***H01R 13/627*** | (2006.01) |
| ***H01R 13/506*** | (2006.01) |
| ***H01R 13/66*** | (2006.01) |
| ***H01R 4/48*** | (2006.01) |
| ***H01R 13/11*** | (2006.01) |
| ***H01R 12/58*** | (2011.01) |
| ***H01R 13/53*** | (2006.01) |

(52) U.S. Cl.
CPC ..... *H01R 12/585* (2013.01); *H01R 13/112* (2013.01); *H01R 13/506* (2013.01); *H01R 13/53* (2013.01); *H01R 13/627* (2013.01); *H01R 13/665* (2013.01)

(58) Field of Classification Search
CPC .... H01R 13/627; H01R 13/53; H01R 13/112; H01R 13/506
See application file for complete search history.

(56) References Cited

U.S. PATENT DOCUMENTS

| | | | | |
|---|---|---|---|---|
| 11,450,978 | B2 * | 9/2022 | Neef ..... | H01R 13/112 |
| 2013/0189876 | A1 | 7/2013 | Lang et al. | |
| 2014/0273628 | A1 | 9/2014 | De Chazal | |
| 2018/0309243 | A1 | 10/2018 | Kurosawa | |

* cited by examiner

HIGH VOLTAGE CONTACT SYSTEM

CROSS-REFERENCE TO RELATED APPLICATIONS

This application is a continuation of U.S. patent application Ser. No. 16/816,619 (now U.S. Pat. No. 11,450,978), filed Mar. 12, 2020, which claims priority to U.S. Provisional Patent Application No. 62/819,022, filed Mar. 15, 2019, the entire disclosure of each of which is incorporated herein by reference in their entireties, for any and all purposes.

FIELD

The present application relates generally to the field of electrical connectors, and more particularly to a high voltage electrical connector.

BACKGROUND

The following description is provided to assist the understanding of the reader. None of the information provided or references cited are admitted to be prior art.

Various types of connectors are used for forming connections between a wire and any manner of electronic or electrical component. These connectors are typically available as sockets, plugs, and shrouded headers in a vast range of sizes, pitches, and plating options. Traditionally, an electrical connection between a wire and printed circuit board (PCB) is formed by soldering the core of the wire onto an electrical pad of the PCB. This process can be tedious, inefficient, and undesirable and result in a high scrap rate, which may be expensive. Moreover, once a solder has been made, the connection is not reparable, and a replacement would require new components. This is undesirable in applications where components cannot be easily reachable (e.g., a connection to a vehicle's PCB). Thus, a quick, efficient, and reliable means of connecting high-voltage wires with interlocks to printed circuit boards is needed.

SUMMARY

The systems, methods, and devices of this disclosure each have several innovative aspects, no single one of which is solely responsible for the desirable attributes disclosed herein.

An electrical connector is disclosed. The electrical connector includes a first electrical contact. The first electrical contact includes a transition portion, a female end, and a press-fit end. The transition portion includes a female-end base and a press-fit base. The female end includes a first contact tine portion extending from the female-end base to a first distal end and a second contact tine portion that extends from the female-end base to a second distal end. The press-fit end includes at least a first compliant pin that extends from the press-fit base to a third distal end. The first distal end and the second distal end are separated by a first distance, and the first contact tine portion at the female-end base and the second contact tine portion at the female-end base are separated by a second distance. The second distance is greater than the first distance. That is, the first distal end and the second distal end create a compression point that may receive and compress a corresponding electrical prong, contact tine, pin, etc.

In an embodiment, the first contact tine portion extends at an interior angle relative to the female-end base that is equal to a second interior angle that the second contact tine portion extends relative to the female-end base. Further, the first contact tine portion may include multiple prongs (i.e., smaller contact tines) that extend in a first prong plane, and the second contact tine portion may include multiple prongs (i.e., smaller contact tines) that extend in a second prong plane. In alternative embodiments, the first contact tine portion may extend away from the female-end base to a distance and curve back toward the female-end base and toward the second contact tine portion to the distal end. Similarly, the second contact tine portion may extend away from the female-end base to the same distance and curve back toward the female-end base and toward the first contact tine portion to the distal end. In this way, the first and second distal ends create a barb-like retention of a corresponding prong or contact tine when the corresponding prong or contact tine is compressed into the female end. The female-end base of the transition portion may extend along a first plane and the press-fit base may extend along a second plane. The first and second planes may be parallel or perpendicular.

The transition portion may also include a connecting portion that connects the female-end base to the press-fit base and aligns the female-end base in the first plane and aligns the press-fit base in the second plane. The press-fit end may also include retention ribs that extend outwardly from the proximal end of the compliant pin and that are configured to stabilize the electrical contact relative to either an insulative housing or a base housing. In an embodiment, the retention ribs extend substantially perpendicular to the direction that the first compliant pin extends and in a second plane which the press-fit base extends. The first contact tine portion extends away from the female-end base to a distance and curves back toward the female-end base and toward the second contact tine portion to the distal end, and wherein the second contact tine portion extends away from the female-end base to the distance and curves back toward the female-end base and toward the first contact tine portion to the distal end.

An embodiment of the electrical connector may include a first electrical contact, a second electrical contact, a first interlocking contact, and a second interlocking contact. Each of the electrical contacts may include a female end, a transition portion, and a press-fit end. The electrical connector may also include an insulative housing. The insulative housing includes a first recess configured to receive at least a portion of the first electrical contact, a second recess configured to receive at least a portion of the second electrical contact, a third recess configured to receive at least a portion of to the first interlocking contact, and a fourth recess configured to receive at least a portion of the second interlocking contact. In an embodiment, the insulative housing may also include a first and second electrical contact retention opening that are each configured to receive and retain one of the press-fit ends.

In an operation, a bottom of an electrical connector is aligned adjacent to a printed circuit board and the press-fit compliant pins of the electrical connector are compressed into respective conductive holes of the printed circuit board. The compression causes the press-fit compliant pins to squeeze (via a slot in the middle of the pins) as the press-fit compliant pins are forced into the conductive holes. The press-fit compliant pins then expand once they are fully inserted into the conductive holes and a stable, reliable, and corrosion-resistant electrical and mechanical connection is formed therebetween. In a second operation, a plug is aligned adjacent to a side of the electrical connector, and the plug and the electrical connector are compressed together. The compression causes a first electrical prong to enter into a female end of a first electrical contact and for the contact tines of the female end to compress the first electrical prong in order to form a mechanical and electrical connection therebetween. Similarly, the compression causes a second electrical prong to enter into a female end of a first electrical contact and a mechanical and electrical connection form therebetween. Additionally, the compression causes a first interlock prong to enter into a female end of a first interlock contact and a second interlock prong into a female end of a second interlock contact in order to form electrical and mechanical connections therebetween. In this way, the first and second electrical prongs and the first and second interlock pins are electrically connected to their respective conductive holes of the printed circuit board.

The electrical connector is not limited by its number of wire openings or other components. Particular embodiments of electrical connectors are described in greater detail below by reference to the examples illustrated in the various drawings.

DETAILED DESCRIPTION

Figure 1:
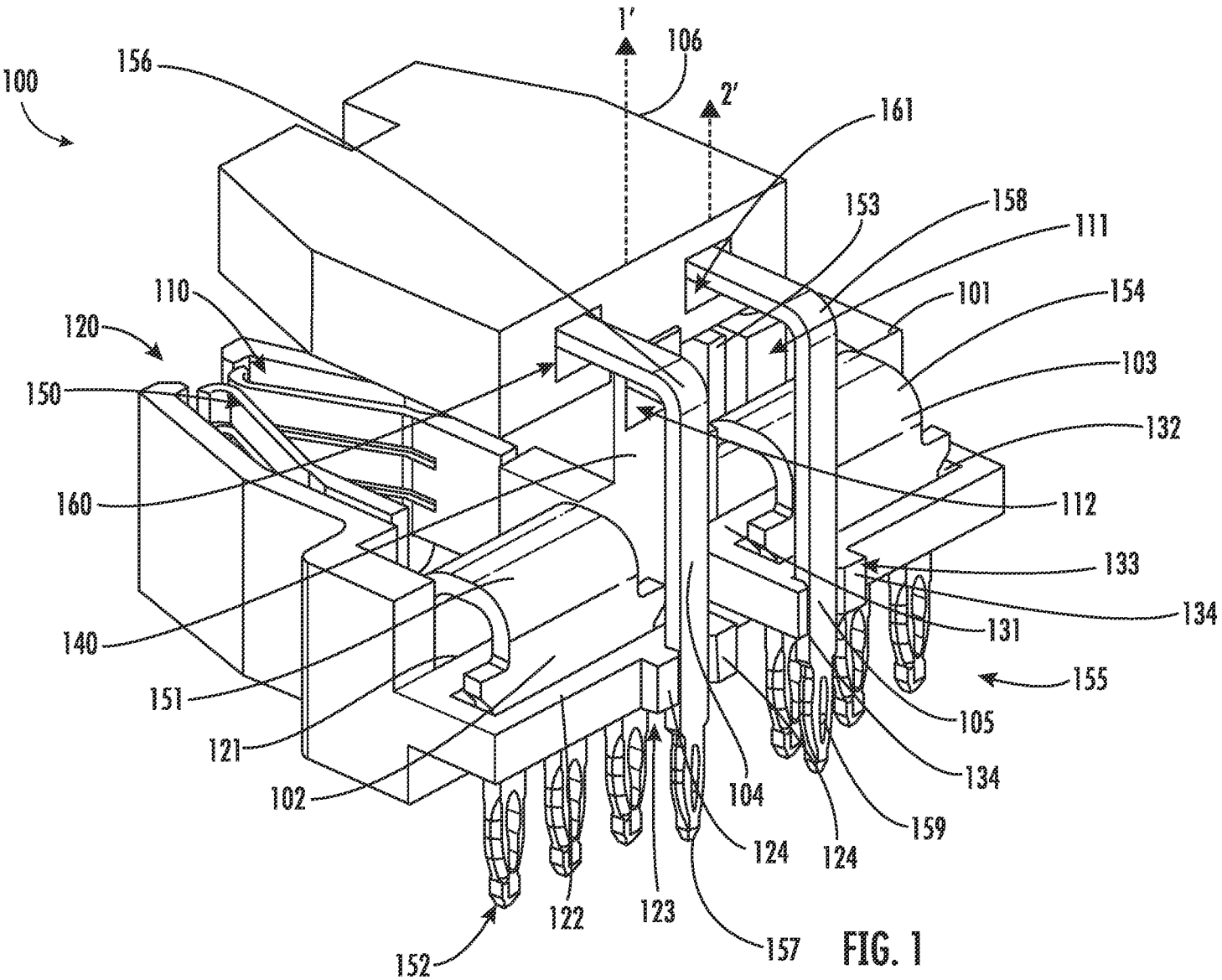
FIG. 1 depicts an isometric view of an electrical connector in accordance with an illustrative embodiment.

Reference will now be made to various embodiments, one or more examples of which are illustrated in the figures. The embodiments are provided by way of explanation of the invention and are not meant as a limitation of the invention. For example, features illustrated or described as part of one embodiment may be used with another embodiment to yield still a further embodiment. It is intended that the present application encompass these and other modifications and variations as come within the scope and spirit of the invention.

Disclosed herein is an electrical connector. The electrical connector can be used with a variety of corresponding connectors and electrical components. For example, the electrical connector may be used with a printed circuit board (PCB) and/or an electrical plug. In an embodiment, the electrical connector includes two electrical contacts, two interlock contacts, and an insulative housing. Each of the electrical contacts and the interlock contacts includes a female end, a transition portion, and a press-fit end. The insulative housing includes a plurality of recesses which retain and support the electrical contacts when in use. Such an electrical contact may be used to efficiently and reliably mechanically and electrical couple a wire with interconnects (or a plug that that is connected to the wires) to a printed circuit board. Specifically, the electrical connector allows for a male-end plug to be connected to the female ends of the contacts and further connected to components of the PCB via the press-fit end of the electrical contacts. Further, the insulative housing provides rigidity and reliability to the connections while also providing safety to the user. The unique design of the electrical contacts increases the versatility of the electrical connector. Specifically, the transition portion aligns the female end and the press-fit end to ensure proper positioning of the electrical contacts during use in a particular application (e.g., in vehicles where PCB connections are exposed to thermal expansion and vibrations and are positioned in unreachable places). Further, the transition portion provides support the electrical contacts within the insulative housing to ensure a reliable and robust electrical connection between the plugs/wires and the PCB. Traditionally, a user must manually handle each wire and solder the wire to a contact pad of the PCB or the PCB must be pre-fabricated to accept a particular plug. However, the design of this wire guide allows a user to plug in a variety of plugs and simply guide the press-fit pins into their respective holes on a printed circuit board.

Various embodiments of an electrical connectors and various corresponding electrical components are illustrated throughout FIGS. 1 through 9. The electrical connector disclosed in these figures is configured to assist in the electrical and mechanical connection of multiple wires to a corresponding electrical component. In an embodiment, the electrical guide may have more or fewer electrical contacts. Furthermore, the wire guide may be used with a variety of electrical plugs, wires, and/or printed circuit boards (PCB). It should be appreciated that the electrical connectors disclosed herein are not limited by a maximum number of wire positions, corresponding electrical contacts, press-fit pins, or types of connections that couple each component together.

FIG. 1 depicts an isometric view of an electrical connector 100 in accordance with an illustrative embodiment. The electrical connector 100 includes an insulative housing 101, a first electrical contact 102, a second electrical contact 103, a first interlock contact 104, and a second interlock contact 105. In an embodiment, the electrical connector 100 may also include a secondary housing 106. The secondary housing 106 may be affixed to the insulative housing 101, e.g., by friction fit between corresponding portions of the housings, by adhesive, by fastener, or by any other suitable mechanism. That is, the secondary housing 106 may be adhered, latched, or molded to the insulative housing 101. The secondary housing 106 allows for a female end of the interlock contacts 104 and 105 to be placed in a specific position relative to the first and second electrical contacts 102 and 103, which broadens the versatility of the electrical connector 100. That is, the secondary housing 106 includes a first interlock recess 160 and a second interlock recess 161. In an embodiment, the first interlock recess 160 houses and retains at least a portion of the first interlock contact 104, and the second interlock recess 161 houses and retains at least a portion of the second interlock contact 105. The first and second interlock recesses 160 and 161 extend entirely through the secondary housing 106. In alternative embodiments, (e.g., when the secondary housing 106 is not used with the insulative housing 100), the portion of first and second interlock contacts 104 and 105 may be housed and retained within recesses of the insulative housing 101.

The insulative housing 101 includes a first recess 110, a second recess 111, a third recess 112, and a fourth recess (not depicted). The insulative housing 101 also includes a center portion 140. The center portion 140 separates the first recess 110 (and corresponding electrical contact 102) from the second recess 111 (and corresponding electrical contact 103). Additionally, the center portion 140 includes the third recess 112 and the fourth recess (not depicted). The third recess 112 is positioned above the fourth recess (not depicted) in a plane that is parallel to the plane which the center portion 140 extends. The third and fourth recesses 112 and (not depicted) are configured to receive a portion (e.g., the female end) of their respective interlock contacts. In an embodiment, the third and fourth recesses 112 and (not depicted) extend entirely through the center portion 140 of the insulative housing 101.

The first recess 110 houses at least a portion of the first electrical contact 102. The second recess 111 houses at least a portion of the second electrical contact 103. In alternative embodiments, the third recess 112 may house and retain at least a portion of the first interlock contact 104 and the fourth recess (not depicted) may house and retain at least a portion of the second interlock contact 105. That is, in an alternative embodiment, the third recess 112 and the fourth recess (not depicted) of the insulative housing 101 may house interlock contacts instead of the secondary housing 106. In yet alternative embodiments, the first interlock recess 160, second interlock recess 161, third recess 112, and/or fourth recess (not depicted) may house at least a portion of a respective interlock contact.

Insulating housing 101 includes an opening 120 that is configured to allow a corresponding electrical component to enter the housing in order to mechanically and electrically connect to the first electrical contact 102. The insulating housing 101 also includes a back ridge 121 and a contact retention opening 122. The back ridge 121 provides support to a corresponding electrical contact that is disposed within the first recess 110. The contact retention opening 122 is an elongated opening that allows for a portion of the corresponding electrical contact 102 to extend there through. The contact retention opening 122 provides stability to a portion (e.g., a transition portion and a press-fit end) of the first electrical contact 102 while the insulative housing 101 is positioned relative to a corresponding electrical component. Further, the contact retention opening 122 may also include an interlock support 123. The interlock support 123 may include two support members 124 that are configured to mechanically touch a portion of a corresponding interlock contact in order to provide rigidity to the corresponding interlock contact while the insulative housing 101 is positioned relative to a corresponding electrical component. In alternative embodiments, other components may be used in order to provide rigidity to the interlock contact from the insulative housing 101.

Similarly, the insulative housing 101 includes a second opening (not depicted) that is configured to allow a corresponding electrical component to enter the housing in order to mechanically and electrically connect to the second electrical contact 103. The insulative housing 101 also includes a back ridge 131 with a contact retention opening 132. The back ridge 131 provides support to corresponding electrical contact 103 that is disposed within the second recess 111. The contact retention opening 132 is an elongated opening that allows for a portion of the corresponding electrical contact 103 to extend therethrough. The contact retention opening 132 provides stability and rigidity to a portion (e.g., a transition portion and a press-fit end) of the second electrical contact 103 while the insulative housing 101 is positioned relative to a corresponding electrical component. Further, the contact retention opening 132 may also include an interlock support 133. The interlock support 133 includes two support members 134 that are configured to mechanically touch a portion of a corresponding interlock contact in order to provide rigidity and support to the corresponding interlock contact while the insulative housing 101 is positioned relative to a corresponding electrical component. In alternative embodiments, other support components may be used in order to provide rigidity to the interlock contact from the insulative housing 101.

As will be discussed in greater detail below, the first electrical contact 102 includes a female end 150, a transition portion 151, and a press-fit end 152. Similarly, the second electrical contact 103 includes a female end 153, a transition portion 154, and a press-fit end 155. The first interlock contact 104 includes an interlock female end (not depicted), an interlock transition portion 156, and an interlock press-fit end 157. Similarly, the second interlock contact 105 includes an interlock female end (not depicted), an interlock transition portion 158, and an interlock press-fit end 159. The transition portions 151 and 154 are designed to traverse the back ridges 121 and 131 of the first and second recesses 110 and 111 in order to provide mechanical support and rigidity to the first and second electrical contacts 102 and 103. Further, the transition portions 151 and 154 are designed to align the respective female ends 150 and 153 relative to the press-fit ends 152 and 155 such that each electrical contact is positioned properly and secured within the electrical housing (within the recesses 110 and 111 and within the contact retention openings 122 and 123).

Figure 2A:
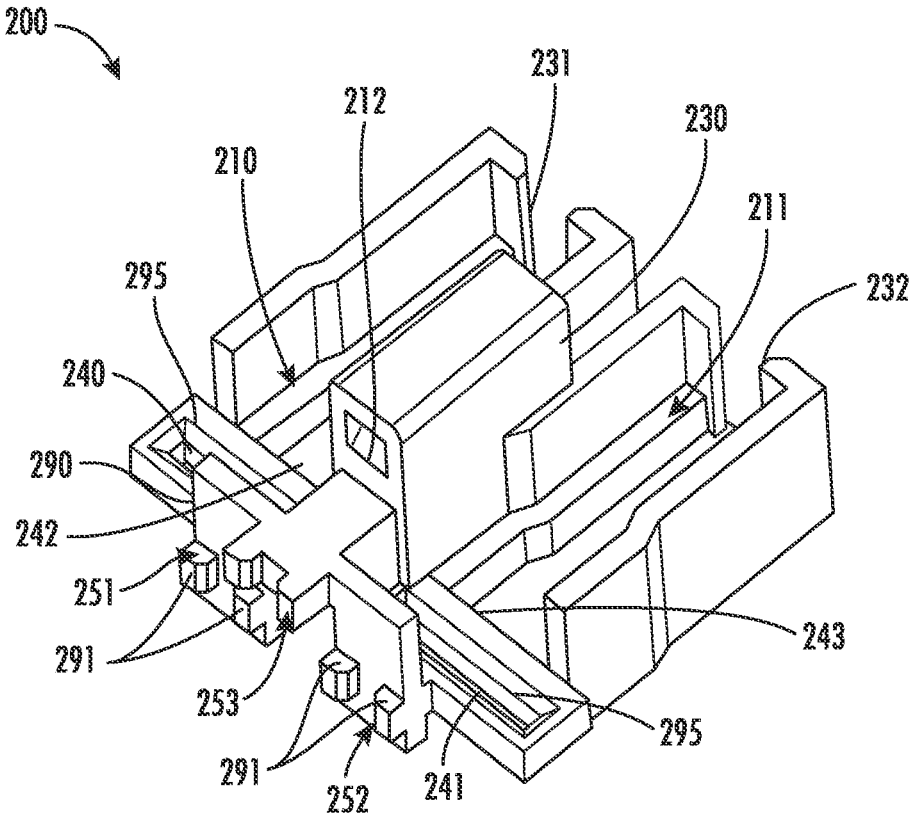
FIGS. 2*a* and 2*b* depict isometric views of an insulative housing in accordance with illustrative embodiments.
Figure 2B:
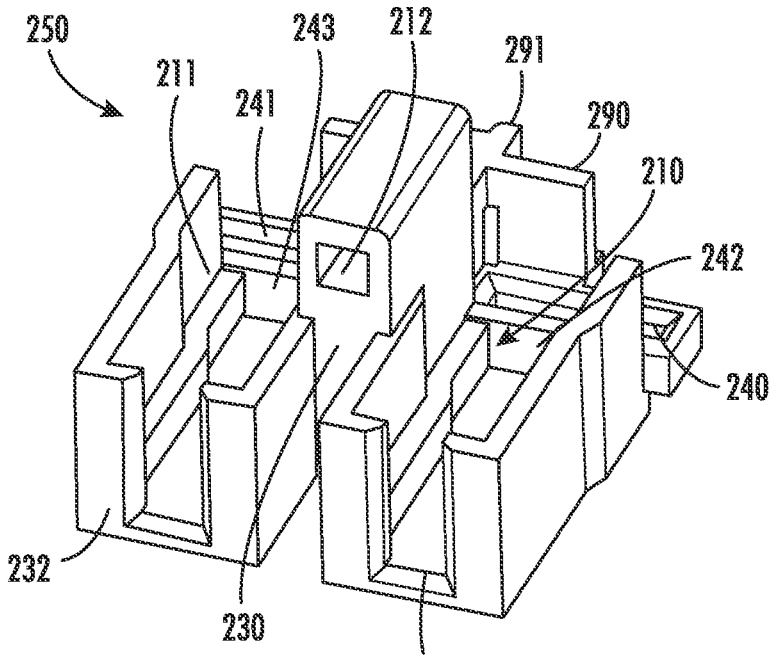

FIGS. 2*a* and 2*b* depict isometric views of an insulative housing in accordance with illustrative embodiments. FIG. 2*a* depicts an isometric view of an insulative housing 200. FIG. 2*b* depicts a different isometric view of an insulative housing 250. Referring to both FIGS. 2*a* and 2*b*, the insulative housing 200 and 250 include a first recess 210, a second recess 211, a third recess 212, and a fourth recess (not depicted). The first and second recesses 210 and 211 are configured for a respective electrical contact (not depicted). The insulative housing 200 also includes a center portion 230. The insulative housing 200 openings 231 and 232 that allow for a corresponding electrical component to enter the insulative housing 200 in order to mechanically and electrically connect to the electrical contacts (not depicted) disposed within the recesses 210 and 211. The insulative housing 200 and 250 also include a first contact retention opening 240 and a second contact retention opening 241 that are disposed behind a first and second ridge 242 and 243 of the first and second recesses 210 and 211, respectively. The first and second contact retention openings 240 and 241 include a bevel 295 that is designed to allow retention ribs of a corresponding electrical contact to slide and create a strong mechanical rigidity therebetween. For example, a press-fit end of an electrical contact protrudes through the contact retention opening, and retention ribs provide support from all lateral movements in order for the press-fit pins to be compressed into corresponding PCB holes without damaging the components.

The insulative housing 200 and 250 may also include a first interlock support 251, a second interlock support 252, and a third interlock support 253. In alternative embodiments, there may be more or fewer interlock supports. The interlock supports 251, 252, and 253 are positioned below (i.e., in a centerline closer to the bottom of the insulative housing where the PCB will be) the interlock recesses 212 and (not depicted) of the insulative housing 200 and 250 and/or below the interlock recesses of a secondary housing (not depicted). The interlock supports 251, 252, and 253 may include a back member 290 and two lateral support members 291. The back member 290 and the two lateral support members 291 provide support to a portion (e.g., a transition portion) of interlocking contacts (not depicted) in order for the press-fit pins of the interlock contacts (not depicted) to be compressed into corresponding PCB holes without damaging the PCB or the interlock contacts.

Figure 3A:
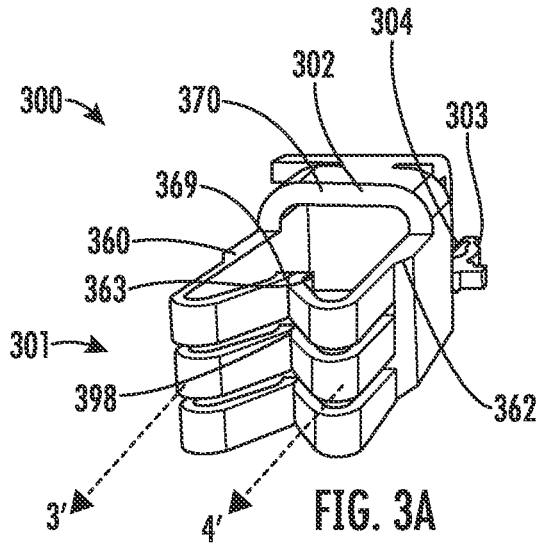
FIGS. 3*a*-3*d* depict isometric views of an electrical contact in accordance with illustrative embodiments.
Figure 3B:
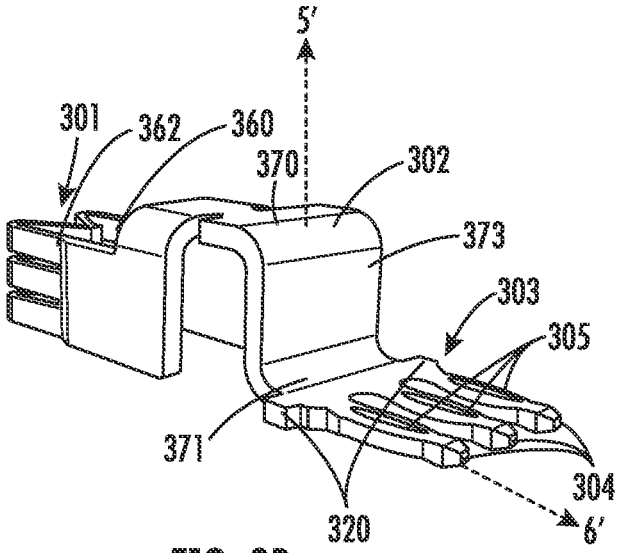
Figure 3C:
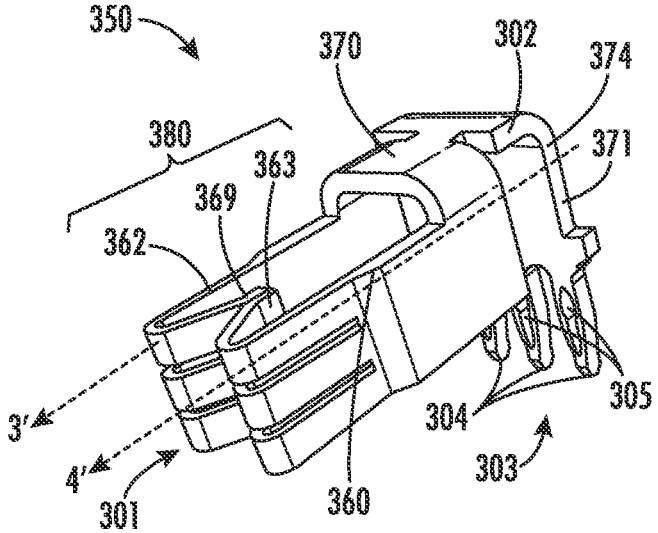
Figure 3D:
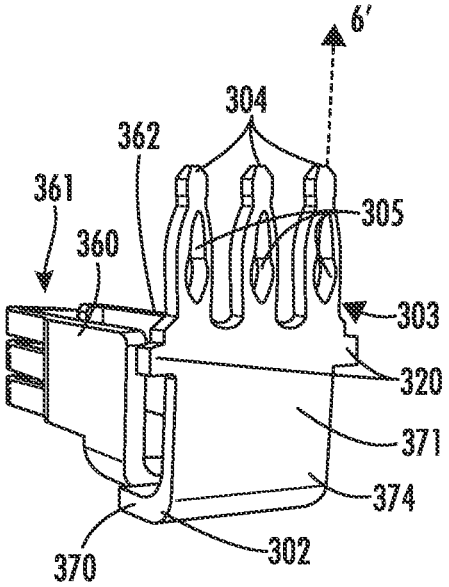

FIGS. 3*a*-3*d* depict isometric views of an electrical contact in accordance with illustrative embodiments. Particularly, FIGS. 3*a* and 3*b* depict a first embodiment of an electrical contact 300 in two different views. FIGS. 3*c* and 3*d* depict a second embodiment of an electrical contact 350 in two different views. Referring generally to FIGS. 3*a*-3*d*, the electrical contacts 300 and 350 include a female end 301, a transition portion 302, and a press-fit end 303. In this example, the press-fit end 303 includes three press-fit compliant pins 304 that are configured to be inserted into respective holes on a PCB board. The three press-fit compliant pins 304 each include a center slot 305. The center slot 305 allows for the pins to compress horizontally as the press-fit compliant pin 304 is vertically compressed into the corresponding hole on the PCB. The horizontal compression results in the press-fit compliant pins 304 having stored elastic energy and further exerting an outward force (e.g., against the corresponding conductive hole of the PCB). The outward force ensures that a mechanical and electrical connection is maintained between the electrical contacts and the PCB. The press-fit compliant pins 304 extend from the transition portion 302 (i.e., proximal end) to a distal end 312. Specifically, the transition portion 302 includes a female-end base 370 and a press-fit base 371. The press-fit compliant pins 304 all extend in a parallel direction on a first plane (not depicted) as the press-fit base and one another. The female-end base 370 extends in a second plane (not depicted).

Still referring generally to FIGS. 3*a*-3*d*, the electrical contacts 300 and 350 may also include two retention ribs 320 that extend outwards from the transition portion 302 near the proximal end of the press-fit compliant pins 304. The retention ribs 320 both restrict how far the press-fit compliant pins 304 may be inserted into an opening of an insulative housing and also provide a structural support for the press-fit compliant pins 304 by mechanically touching the inside of the opening of the insulative housing and thereby preventing lateral movements. The female end 301 includes two contact tines 360 and 362 that extend from an end (i.e., the female-end base 370) of the transition portion 302 that is opposite that the press-fit compliant pins 304 extend from. The two contact tines extend from the transition portion 302 to a distal end 362. In an embodiment, the contact tines 360 and 362 extend from opposite edges of the transition portion 302. The contact tines 360 and 362 may extend from the transition portion 302 toward the other contact tine (e.g., toward a centerline axis 399). In some embodiments, the contact tines 360 and 362 extend outwardly from the transition portion 302 a distance 380, curve such that the contact tines 360 and 362 extend toward the other contact tine and extend back toward the transition portion 302 to the distal ends 369. Further, the distal ends 369 may comprise a flat portion 363, and each of the flat portions 363 may rest against another flat portion of the opposite contact tine 360 or 362. In alternative embodiments, the contact tines 360 and 362 may extend from the transition portion 302 toward each other in order to create a pinch-point 398 and include a bevel on the distal end 369 that allows a corresponding electrical component to enter between and be compressed by the contact tines 360 and 362. In another example embodiment, the first and second contact tines 360 and 362 may each include one, two, three, four, or more smaller contact tines that all extend in a similar manner. The multiple smaller contact tines allow for the electrical contacts 300 and 350 to better form to and compress a corresponding prong that is inserted into the female end. In alternative embodiments, the contact tines 360 and 362 may be in any configuration that allows for the contact tines 360 and 362 to compress a corresponding electrical component in order to create a mechanical and electrical connection therebetween.

Referring generally now to FIGS. 3*a* and 3*b*, the first embodiment of an electrical contact 300 is arranged such that a corresponding insulative housing can be used in a straight (i.e., 180 degree) direction. That is, the transition portion 302 is designed such that the first plane (not depicted) (e.g., the plane that the multiple press-fit compliant pins 304 extend along) is parallel to the second plane (not depicted) (e.g., the plane that the female-end base extends along 370). That is, the multiple press-fit compliant pins 304 extend in one direction while the contact tines 360 and 362 extend in an opposite (180 degree) direction. In addition to this, a retention base 373 of the transition portion 302 connects the female-end base 370 to the press-fit base 371. The retention base 373 allows for the electrical contact to sit (e.g., be secured) within a recess of a corresponding insulative housing while allowing the multiple press-fit compliant pins 304 to be positioned outside of the insulative housing.

Referring generally now to FIGS. 3*c* and 3*d*, the second embodiment of the electrical contact 350 is arranged such that a corresponding insulative housing can be used in a perpendicular (i.e., 90 degree) direction. That is, the transition portion 302 is designed such that the first plane (not depicted) is perpendicular to the second plane (not depicted). That is, the multiple press-fit compliant pins 304 extend in one direction while the contact tines 360 and 362 extend in a perpendicular (90 degree) direction. In an embodiment, a retention connection 374 of the transition portion 302 connects the female-end base 370 to the press-fit base 371. This design allows for the electrical contact to sit (e.g., be secured) within a recess of a corresponding insulative housing while allowing the multiple press-fit compliant pins 304 to be positioned outside of the insulative housing. In other words, the retention connection 374 is similar to the retention base 373 in that their design allows for the electrical contact 350 to sit within a recess, extend over a ridge in the recess, and extend out of the insulative housing without sacrificing stability of the electrical contact within the insulative housing.

Figure 4A:
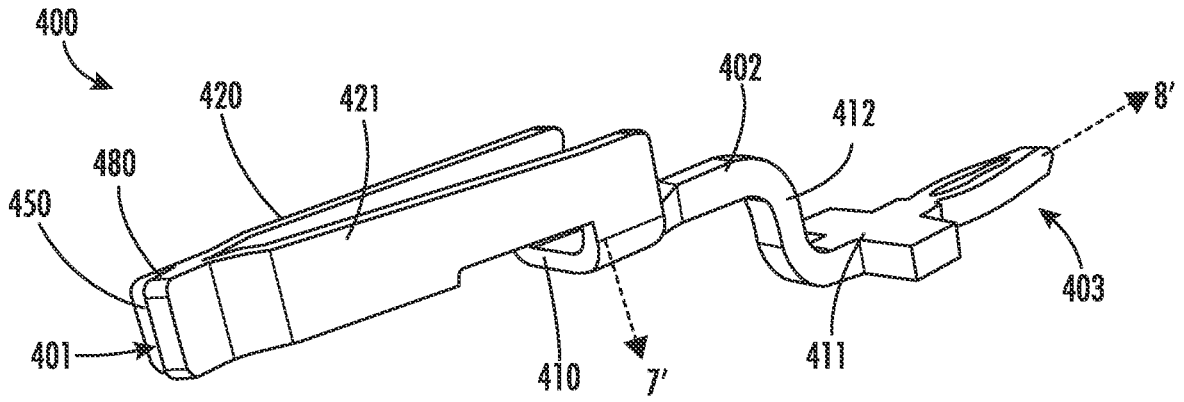
FIGS. 4*a* and 4*b* depict isometric views of an interlocking electrical contact in accordance with illustrative embodiments.
Figure 4B:
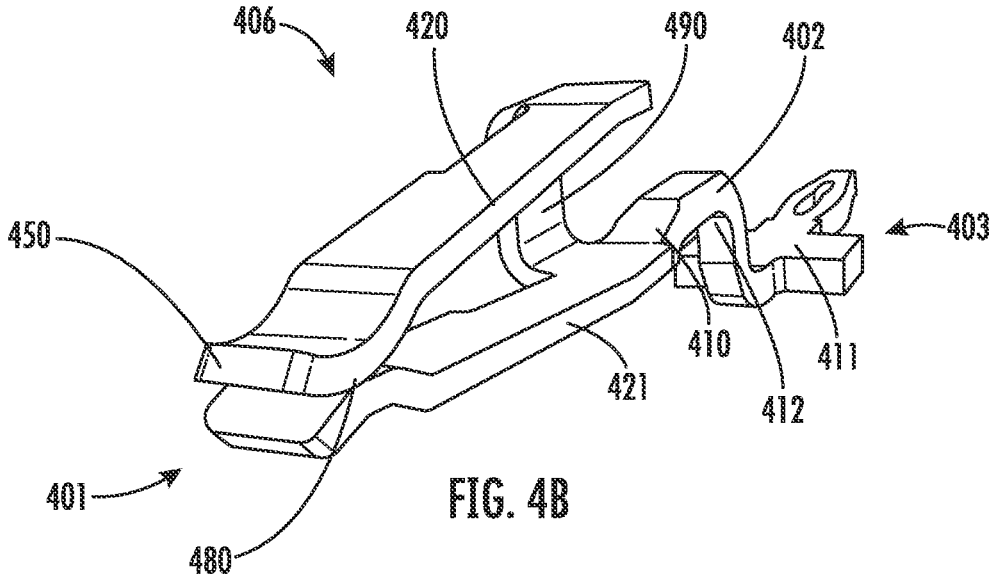

FIGS. 4*a*-4*b* depict isometric views of an interlocking electrical contact 400 in accordance with illustrative embodiments. The interlocking electrical contact 400 includes a female end 401, a transition portion 402, and a press-fit end 403. The transition portion 402 includes a female-end base 410, a press-fit base 411, and a retention base 412. The female-end base 410 extends in a first plane (not depicted), and the press-fit base 411 extends in a second plane (not depicted). In an embodiment, the first plane (not depicted) and the second plane (not depicted) are parallel. In alternative embodiments, the first plane (not depicted) and the female-end base 410 may be perpendicular to the press-fit base 411 and the second plane (not depicted). The retention base 412 is a shape that conforms to allow the bases 410 and 412 to be aligned in the manner needed for a given application while providing support by coupling with a support member of the insulative housing. In an embodiment, the female end 401 includes a first contact tine 420 and a second contact tine 421. The first and second contact tines 420 and 421 extend from the female-end base 410 to a distal end 450. The distal ends 450 of the first and second contact tines 420 and 421 converge to create a pinch-point 480. The pinch-point 480 allows for a corresponding electrical component to be inserted in and compressed by the first and second contact tines 420 and 421 in order to create a mechanical and electrical connection therebetween. The proximal ends of the first and second contact tines 420 and 421 may be separated by the female-end base 410 or may be separated by a separating member 490. That is, in an embodiment such as depicted in FIG. 4*b*, a separating member 490 may extend from the female-end base 410, and the second contact tine 421 may extend from a distal end of the separating member 490. In alternative embodiments, such as depicted in FIG. 4*a*, the first and second contact tines 420 and 421 may extend from opposite sides of the female-end base 410.

Figure 5A:
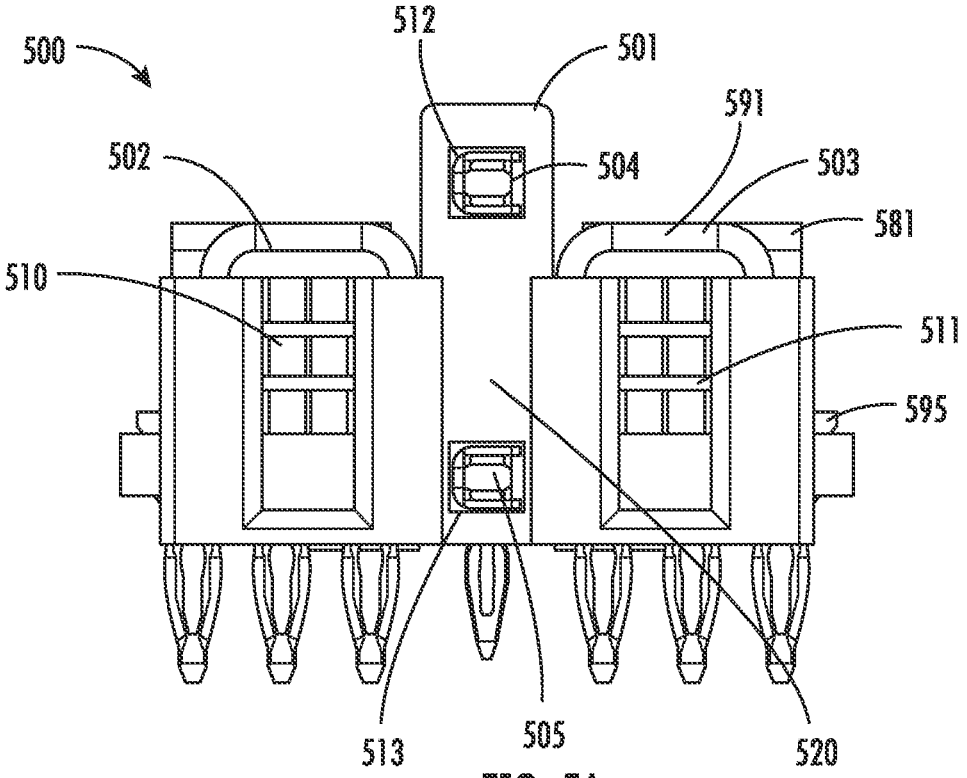
FIG. 5*a* depicts a rear view of an electrical connector in accordance with an illustrative embodiment.
Figure 5B:
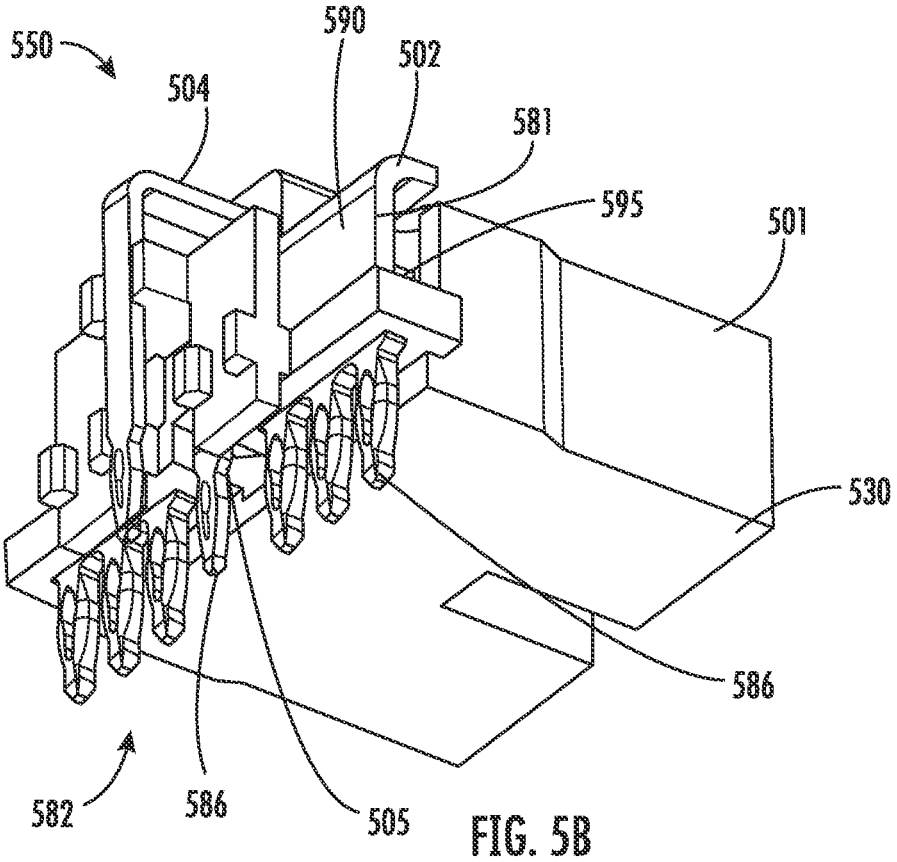
FIG. 5*b* depicts a bottom-up isometric view of an electrical connector in accordance with an illustrative embodiment.

FIG. 5*a* depicts a rear view of an electrical connector 500 in accordance with an illustrative embodiment. FIG. 5*b* depicts a bottom-up isometric view of an electrical connector 550 in accordance with an illustrative embodiment. Referring generally to FIGS. 5*a* and 5*b*, the electrical connector 500 and 550 includes an insulative housing 501, a first electrical contact 502, a second electrical contact 503, a first interlock contact 504, and a second interlock contact 505.

Referring generally now to FIG. 5*a*, the insulative housing 501 includes a first opening 510, a second opening 511, a third opening 512, and a fourth opening (not depicted). The four openings 510, 511, 512, and (not depicted) are arranged such that a corresponding plug, wire, or electrical device may enter the openings in order to create a mechanical and electrical connection to the corresponding contacts within the respective opening. The insulative housing also includes a center portion 520. The center portion 520 is configured to mechanically and electrically isolate the first electrical contact 502 from the second electrical contact 503. Further, in an embodiment, the third and fourth openings 512 and (not depicted) may house the first and second interlock contacts 504 and 505. The first and second contacts 502 and 503 include a female end 580, a transition portion 581, and a press-fit end 582.

Referring generally now to FIG. 5*b*, a bottom 530 of the insulative housing 501 is flat. The flat bottom 530 allows for the electrical connector 550 to sit flat on top of a printed circuit board when the electrical contacts 502, 503, 504, and 505 are electrically and mechanically connected to the printed circuit board. The first and second contacts 502 and 503 include a female portion (not depicted), a transition portion 581, and a press-fit end 582. The press-fit end 582 includes at least one press-fit compliant pin 586 that is configured to be pressed into a conductive hole of a corresponding printed circuit board. The press-fit end 582 may extend below the bottom 530 of the insulative housing 501. The transition portion 581 includes a press-fit end base 590, a female-end base 591, and a transition portion 581. The transition portion 581 aligns the press-fit end base 590 and the female-end base 591 in proper positions and retains the first and second contacts 502 and 503 within the housing. The transition portion 581 also includes outwardly extending retention ribs 595 that sit on top of or within contact retention openings 597 of the insulative housing 501. In an embodiment, the press-fit end 582 extends in a perpendicular (or substantially perpendicular) direction relative to the female end 580 and/or the openings 510, 511, 512, and (not depicted) of the insulative housing 501.

Figure 6A:
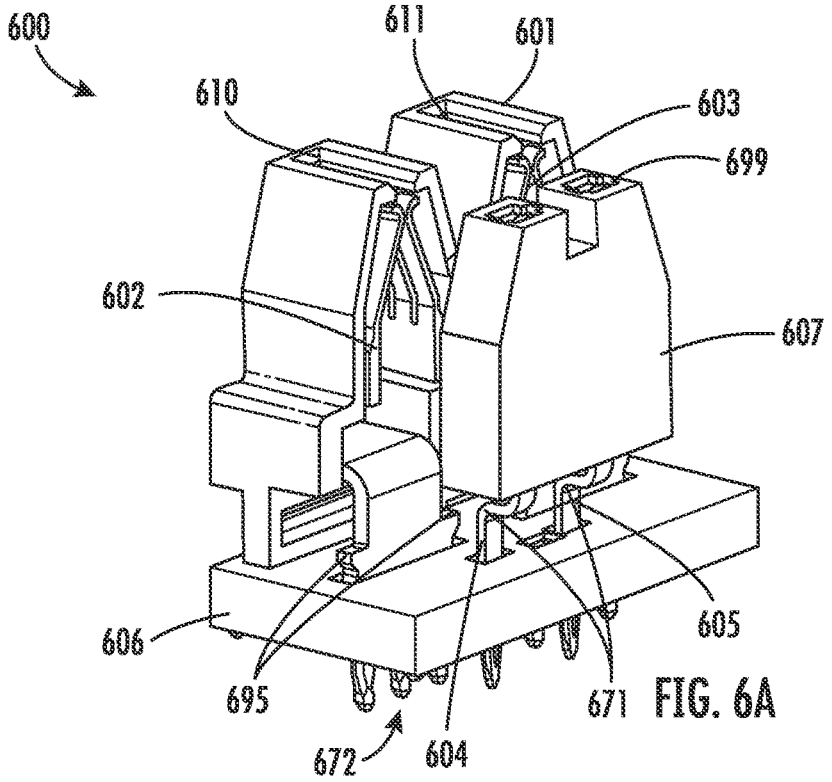
FIGS. 6*a* and 6*b* depict isometric views of an electrical connector in accordance with illustrative embodiments.
Figure 6B:
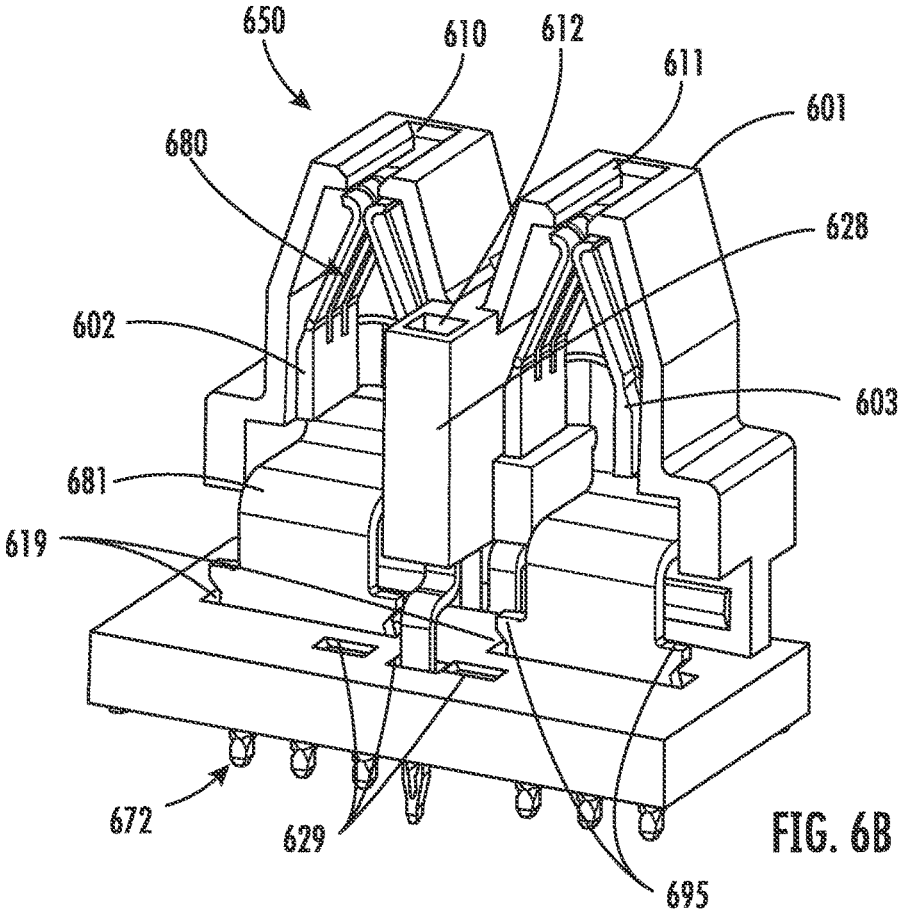

FIG. 6*a* depicts a top-down isometric view of an electrical connector 600 in accordance with an illustrative embodiment. FIG. 6*b* depicts a top-down isometric view of an electrical connector 650 in accordance with an illustrative embodiment. Referring generally to FIGS. 6*a* and 6*b*, the electrical connectors 600 and 650 include an insulative housing 601, a first electrical contact 602, a second electrical contact 603, a first interlock contact 604, a second interlock contact 605, and a base housing 606. The first and second contacts 602 and 603 include a female end 680, a transition portion 681, and a press-fit end 682. The base housing 606 includes two prong openings 619 that are each configured to receive the press-fit end 682 of one of the first or second electrical contacts 602 and 603. The base housing 606 allows for the electrical connector 650 to be used in a straight (i.e., 180 degree) configuration of an electrical plug or component and a printed circuit board. The transition portion 681 also includes outwardly extending retention ribs 695 that sit on top of or within two prong openings 619 of the base housing 601. In an embodiment, the press-fit end 682 extends in a perpendicular (or substantially perpendicular) direction relative to the female end 680 and/or openings 610, 611, 612, and 613 of the insulative housing 601.

The first and second interlock contacts 604 and 605 include a female end 670, a transition portion 671, and a press-fit end 672. The base housing 606 includes four openings 629 that are each configured to receive the press-fit end 672 of one of the first or second interlock contacts 602 and 603. The base housing 606 allows for the electrical connector to be used in a straight (i.e., 180 degree) configuration of an electrical plug or component and a printed circuit board. In an embodiment, the press-fit end 672 extends in a parallel (or substantially parallel) but opposite direction relative to the female end 670 and/or openings 610, 611, 612, and 613 of the insulative housing 601. The press-fit end 672 also extends through and beyond respective interlock openings 629 such that the interlock contacts 604 and 605 extend from both sides of the base housing 606.

Referring generally now to FIG. 6*a*, the electrical connector 600 may also include a secondary housing 607 that is mounted upon a center portion 628 of the insulative housing 601. The secondary housing 607 may be mounted via any known mechanical means in the art. The secondary housing 607 includes two interlock contact openings 699 and is configured to house and secure at least a female end of the first and second interlock contacts 604 and 605. The transition portion 671 is configured to align the female end 670 within the housings 601 and 607 relative to the other contacts and to align the press-fit end 672 to respective openings 629 and or 619 of the base housing 606 such that the base housing 606 and corresponding press-fit pins can electrically and mechanically connect to respective contacts of a printed circuit board.

Figure 7A:
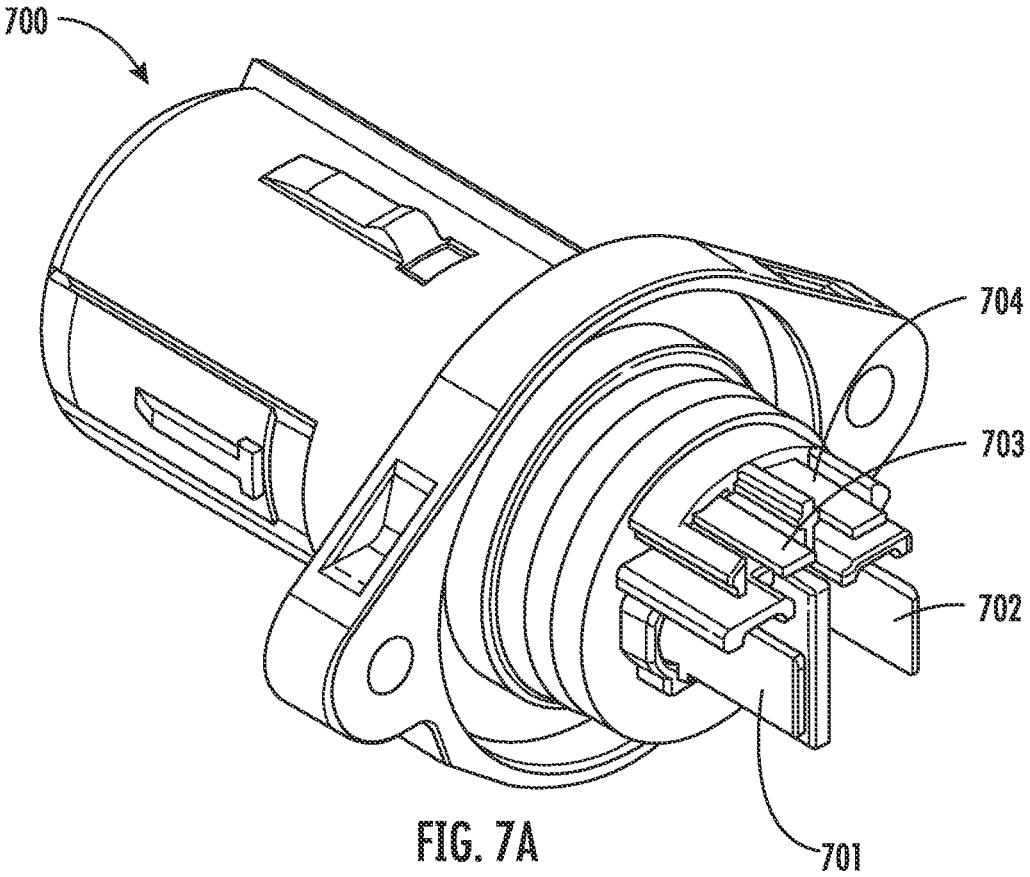
FIGS. 7*a* and 7*b* depict isometric views of example corresponding plugs in accordance with illustrative embodiments.
Figure 7B:
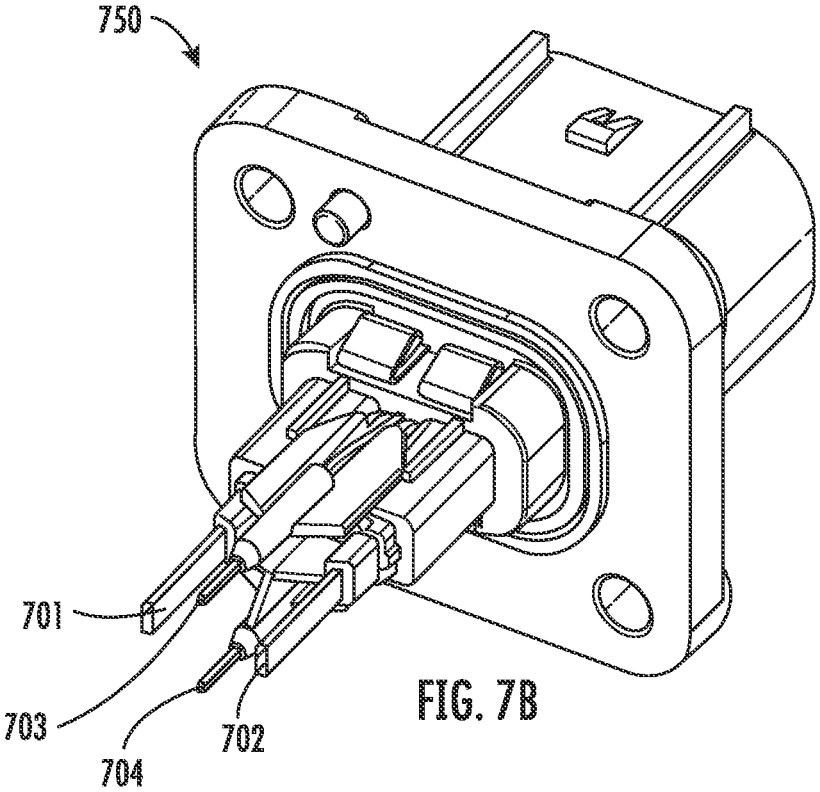

FIG. 7*a* depicts an isometric view of a plug 700 in accordance with an illustrative embodiment. FIG. 7*a* depicts an isometric view of a plug 750 in accordance with an illustrative embodiment. Referring generally to FIGS. 7*a* and 7*b*, the plugs 700 and 750 include a first prong 701, a second prong, 702, a first interconnect prong 703, and a second interconnect prong 704. Referring generally to FIGS. 7*a* and 7*b*, the first interconnect prong 703 and the second interconnect prong 704 are both located on one side of the first and second prongs 701 and 702. For example, the plug 700 may be used with an electrical connector such as the one disclosed in FIG. 1. That is, the plug 700 generally requires the addition of the secondary housing in the electrical connector. Referring generally to FIG. 7*b*, the first interconnect prong 703 is located on one side of the first and second prongs 701 and 702 and the second interconnect prong 704 is located on the opposite side of the first and second prongs 701 and 702. For example, the plug 750 may be used with an electrical connector such as the one disclosed in FIG. 5*a*. That is, the plug 750 generally does not require a secondary housing to be included with the electrical connector.

Referring again generally to FIGS. 7*a* and 7*b*, a corresponding electrical connector is configured to electrically and mechanically connect to each of the prongs 701, 702, 703, and 704 in order to electrically connect each of the prongs 701, 702, 703, and 704 to one or more electrical pads or conductive holes of a printed circuit board. In an embodiment, each of the two prongs 701 and 702 electrically and mechanically connect to respective electrical contacts of the corresponding electrical connector (e.g., via the pinching and compression of the prongs from the contact tines of the electrical contacts). Further, each of the two interconnect prongs 703 and 704 electrically and mechanically connect to respective interlock contacts of the corresponding electrical connector (e.g., via the pinching and compression of the prongs from the contact tines of the interlock contacts).

Figure 8:
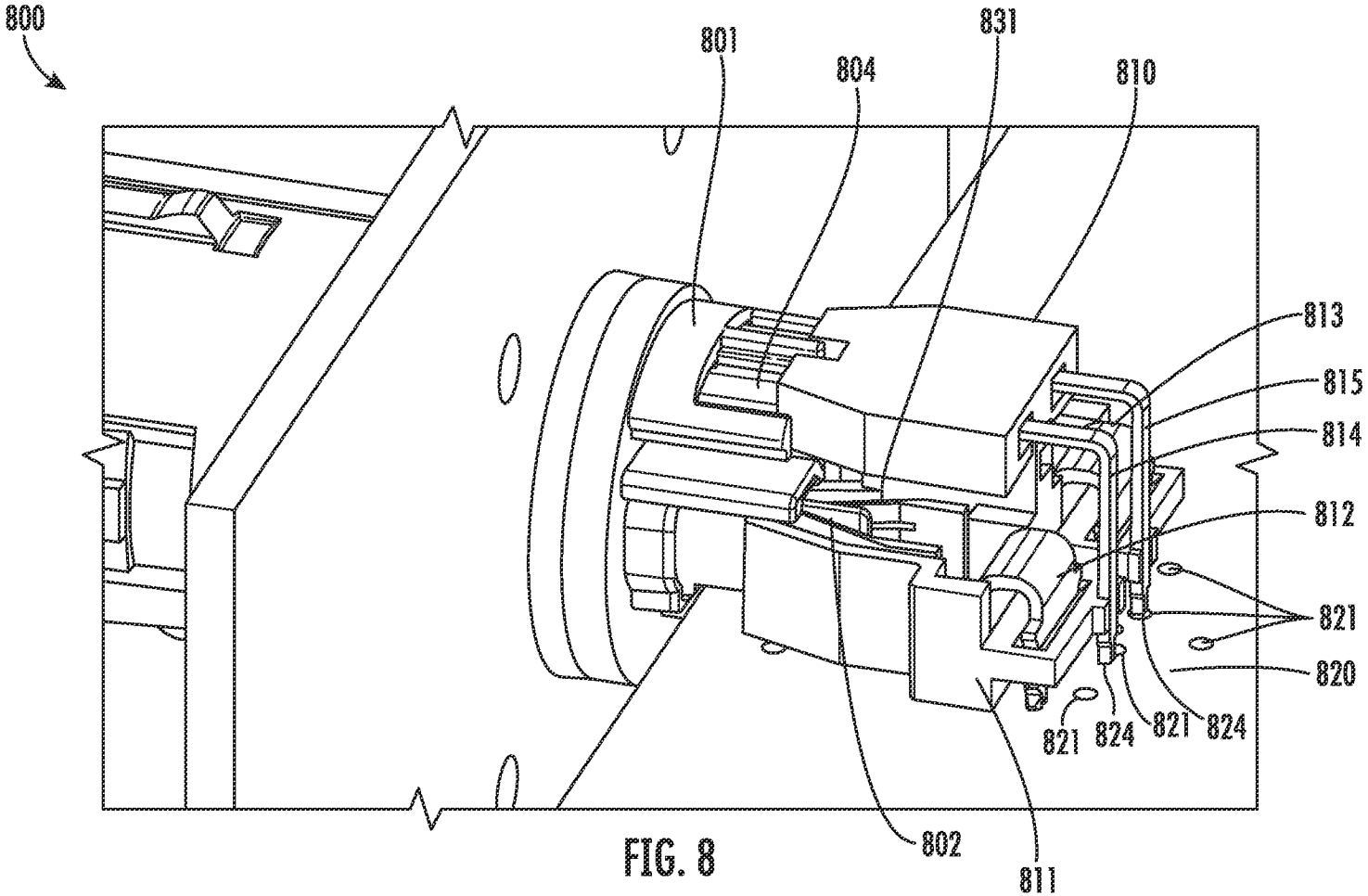
FIG. 8 depicts an isometric view of a plug in use with an electrical connector and a printed circuit board in accordance with an illustrative embodiment.

FIG. 8 depicts an isometric view of an electrical connector in use with a plug and a printed circuit board 800 in accordance with an illustrative embodiment. The plug 801 include a first prong 802, a second prong, (not depicted), a first interconnect prong 804, and a second interconnect prong (not depicted). The electrical connector 810 includes an insulative housing 811, a first electrical contact 812, a second electrical contact 813, a first interlock contact 814, and a second interlock contact 815. The printed circuit board (PCB) 820, includes a plurality of conductive holes 821, each configured to receive a compliant press-fit pin. The first and second electrical contacts 812 and 813 include multiple (e.g., three) press-fit compliant pins (not depicted). In alternative embodiments, there may me more or fewer press-fit compliant pins. The multiple press-fit compliant pins assist in providing stability, rigidity, and also assist in current distribution between the electrical contacts 812 and 813 and the PCB 820. The first and second interlock contacts 814 and 815 include a press-fit compliant pin 824. The first prong 802 is inserted into a female end 831 of the first electrical contact 812 and compressed by a first contact tine and a second contact tine of the first electrical contact 812. Similarly, the second prong (not depicted) is inserted into a female end (not depicted) of the second electrical contact 812 and compressed by a first contact tine (not depicted) and a second contact tine (not depicted) of the second electrical contact 812. The first and second interlock contacts 813 and 814 similarly receive and compress (i.e., pinch) the first and second interlock prongs 804 and (not depicted), respectively, to form an electrical and mechanical connection therebetween. The electrical connector 810 was positioned adjacent to the PCB, each of the compliant press-fit pins (not depicted) and 824 were aligned with respective conductive holes 821 on the PCB and compressed into the conductive holes 821 to form a mechanical and electrical connection therebetween. In this way, each prong 802, (not depicted), 804, and (not depicted) has an electrical connection to one or more conductive components (i.e., conductive holes 821) of the PCB.

Figure 9:
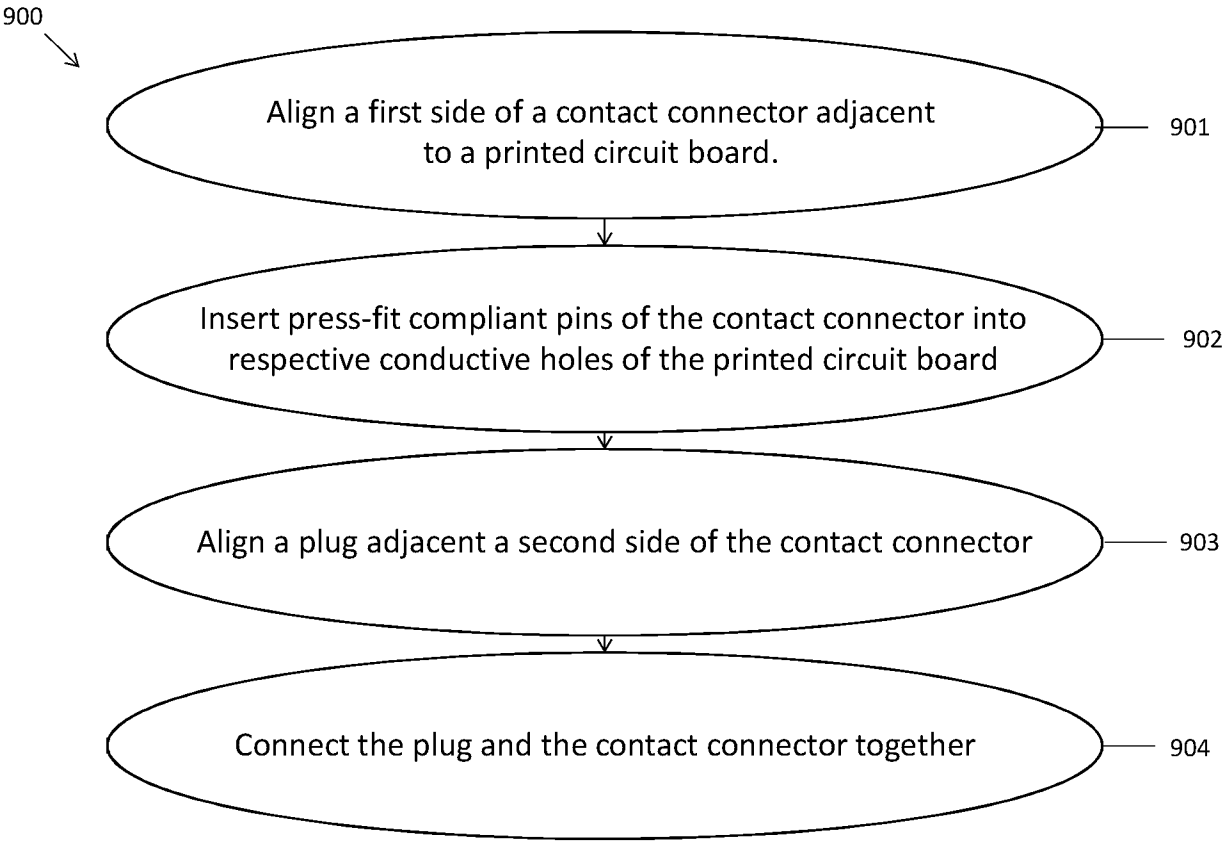
FIG. 9 depicts a flow diagram for a method of use of an electrical connector in accordance with an illustrative embodiment.

FIG. 9 depicts a flow diagram for a method of use of an electrical connector 900 in accordance with an illustrative embodiment. Referring generally to FIGS. 5*a* and 5*b* for reference, in an operation 901, a bottom of an electrical contact connector is aligned adjacent to a printed circuit board. The bottom of the contact connector is aligned such that all of the press-fit compliant pins that extend past the bottom are aligned with a conductive hole (e.g., conductive hole as depicted in FIG. 8) in the printed circuit board. The press-fit compliant pins have a notched end to facilitate placement within the conductive holes.

In an operation 902, the press-fit compliant pins of the electrical contact connector are inserted into respective conductive holes of the printed circuit board. The insertion of the electrical connector and the printed circuit board together causes the press-fit compliant pins to compress while being compressed into the hole and to exert a constant force against the inner circumference of the respective conductive holes. In this way, a mechanical and electrical connection is made between the press-fit compliant pins and the printed circuit board.

Additionally, the squeezing and expanding of each of the press-fit compliant pins ensures that a tight, resilient, and reliable connection is made to each respective conductive hole.

In an operation 903, a plug (e.g., a plug as depicted in FIG. 7*a* or 7*b*) is aligned adjacent to a second side of the electrical connector. The alignment ensures that a first prong of the plug is aligned with a first female end of a first electrical contact of the electrical connector. Further, the alignment ensures that a second prong of the plug is aligned with a second female end of a second electrical contact of the electrical connector. Additionally, the alignment ensures that a first interlock prong of the plug is aligned with a first female end of a first interlock contact of the electrical connector. Lastly, the alignment ensures that a second interlock prong of the plug is aligned with a second female end of a second interlock contact of the electrical connector.

In an operation 903, the plug is compressed together with the electrical connector. The compression causes the first prong to enter the first female end of a first electrical contact and the second prong to enter the second female end of a first electrical contact. The compression also causes the first interlock prong to enter the first female end of a first interlock contact and the second interlock prong to enter the second female second of a first interlock contact. In general, the female ends of the contacts compress the respective prong between two contact tines in order to form a mechanical and electrical connection therebetween. As a general depiction of an embodiment, the result of the method is depicted by FIG. 8

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.) It will be further understood by those skilled in the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.) In instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.) It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. An electrical contact comprising:

a transition portion comprising a female-end base and a press-fit base;

a female end comprising:

a first contact tine portion extending from the female-end base to a distal end;

a second contact tine portion extending from the female-end base to a distal end, wherein the distal end of the first contact tine portion and the distal end of the second contact tine portion form a pinch-point; and a press-fit end comprising a first compliant pin that extends from the press-fit base to a distal end;

wherein the female-end base extends along a first plane and the press-fit base extends along a second plane, and wherein the transition portion further comprises a retention base, wherein the retention base connects the female-end base to the press-fit base and aligns the female-end base in the first plane and aligns the press-fit base in the second plane.

2. The electrical contact of claim 1, wherein the distal end of the first contact tine portion and the distal end of the second contact tine portion are separated by a first distance, and the first contact tine portion at the female-end base and the second contact tine portion at the female-end base are separated by a second distance.

3. The electrical contact of claim 2, wherein the second distance is greater than the first distance.

4. The electrical contact of claim 1, wherein the first contact tine portion extends from the female-end base in a same direction as the second contact tine portion extends.

5. The electrical contact of claim 1, wherein the first contact tine portion comprises multiple prongs extending in a first plane, and the second contact tine portion comprises multiple prongs extending in a second plane.

6. The electrical contact of claim 1, wherein the first plane and the second plane are parallel.

7. The electrical contact of claim 1, wherein the first plane and the second plane are perpendicular.

8. The electrical contact of claim 1, the press-fit end further comprising retention ribs that extend outwardly from a proximal end of the compliant pin.

9. The electrical contact of claim 8, wherein the retention ribs extend substantially perpendicular to the direction that the first compliant pin extends and in a second plane which the press-fit base extends.

10. The electrical contact of claim 1, wherein the first contact tine portion extends away from the female-end base for a distance and curves back toward the female-end base and toward the second contact tine portion to the distal end, and wherein the second contact tine portion extends away from the female-end base for the distance and curves back toward the female-end base and toward the first contact tine portion to the distal end.

11. The electrical contact of claim 10, wherein the first contact tine portion comprises multiple prongs, wherein the second contact tine portion comprises multiple prongs, and wherein each of the multiple prongs comprise a flat portion on the distal end.

12. The electrical contact of claim 11, wherein each of the flat portions of the first contact tine portion mechanically touch one of the flat portions of the second contact tine portion.

13. An electrical connector comprising:

a first electrical contact comprising a first female end, a first transition portion, and a first press-fit end, the first transition portion comprising a female-end base and a press-fit base;

a female end comprising:

a first contact tine portion extending from the female-end base to a distal end;

a second contact tine portion that extends from the female-end base to a distal end, and wherein the distal end of the first contact tine portion and the distal end of the second contact tine portion form a pinch-point; and a press-fit end comprising a first compliant pin that extends from the press-fit base to a distal end, wherein the female-end base extends along a first plane and the press-fit base extends along a second plane, and wherein the first transition portion further comprises a retention base, wherein the retention base connects the female-end base to the press-fit base and aligns the female-end base in the first plane and aligns the press-fit base in the second plane;

a second electrical contact comprising a second female end, a second transition portion, and a second press-fit end;

a first interlocking contact;

a second interlocking contact comprising a pin-receiving end, an interlocking transition portion, and an interlocking press-fit end; and a insulative housing comprising:

a first recess configured to receive a portion of the first electrical contact;

a second recess configured to receive a portion of the second electrical contact;

a third recess configured to receive a portion of the first interlocking contact; and a fourth recess configured to receive a portion of the second interlocking contact.

14. The electrical connector of claim 13, the first transition portion comprising a first connecting portion between the first female-end base and first press-fit base.

15. The electrical connector of claim 13, the female end of the first electrical contact comprising:

a first contact tine portion extending from the female-end base to a distal end;

a second contact tine portion that extends from the female-end base to a second distal end.

16. The electrical connector of claim 13, the insulative housing further comprising:

a first electrical contact retention opening configured to receive the press-fit end of the first electrical contact; and a second electrical contact retention opening configured to receive the press-fit end of the second electrical contact.

17. The electrical connector of claim 13, the insulative housing further comprising:

a first support member configured to mechanically support the first interlocking transition portion; and a second support member configured to mechanically support the second interlocking transition portion.

* * * * *